US011463814B2

(12) United States Patent
Qi et al.

(10) Patent No.: US 11,463,814 B2
(45) Date of Patent: Oct. 4, 2022

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN); Yongjian Li, Shenzhen (CN); Wenbing Zhou, Shenzhen (CN); Zhuyang Jiang, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

(21) Appl. No.: 17/218,804

(22) Filed: Mar. 31, 2021

(65) Prior Publication Data

US 2021/0250700 A1 Aug. 12, 2021

Related U.S. Application Data

(63) Continuation-in-part of application No. 17/170,817, filed on Feb. 8, 2021, now Pat. No. 11,395,072, which (Continued)

(30) Foreign Application Priority Data

Dec. 23, 2011 (CN) ..... 201110438083.9
Jun. 15, 2018 (CN) ..... 201810623408.2

(Continued)

(51) Int. Cl.
*H04R 25/00* (2006.01)
*H04R 9/06* (2006.01)

(Continued)

(52) U.S. Cl.
CPC ..... *H04R 9/063* (2013.01); *H04R 1/00* (2013.01); *H04R 1/10* (2013.01); *H04R 9/02* (2013.01);

(Continued)

(58) Field of Classification Search
CPC ..... H04R 1/2876; H04R 1/04; H04R 1/08; H04R 2410/00; H04R 25/606; H04R 9/06; H04R 9/066; H04R 2460/13
See application file for complete search history.

(56) References Cited

U.S. PATENT DOCUMENTS 2,075,198 A 3/1937 Hand
4,418,248 A 11/1983 Mathis (Continued)

FOREIGN PATENT DOCUMENTS

CN 1842019 A 10/2006
CN 1976541 A 6/2007

(Continued)

OTHER PUBLICATIONS

The Search Report in Russian Application No. 2021100591 dated Jun. 30, 2021, 4 pages.

(Continued)

*Primary Examiner* — Amir H Etesam
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where at least two second rods inside it converge to its center. The vibration conductive plate is fixed with the vibration board; the first torus is fixed on a magnetic system, and the second (Continued)

torus comprises a fixed voice coil, which is driven by the magnetic system. The bone conduction speaker in the present disclosure and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 23 Drawing Sheets

Related U.S. Application Data is a continuation of application No. 17/161,717, filed on Jan. 29, 2021, now Pat. No. 11,399,234, which is a continuation-in-part of application No. 16/159,070, filed on Oct. 12, 2018, now Pat. No. 10,911,876, which is a continuation of application No. 15/197,050, filed on Jun. 29, 2016, now Pat. No. 10,117,026, which is a continuation of application No. 14/513,371, filed on Oct. 14, 2014, now Pat. No. 9,402,116, which is a continuation of application No. 13/719,754, filed on Dec. 19, 2012, now Pat. No. 8,891,792, said application No. 17/161,717 is a continuation-in-part of application No. 16/833,839, filed on Mar. 30, 2020, which is a continuation of application No. 15/752,452, filed as application No. PCT/CN2015/086907 on Aug. 13, 2015, now Pat. No. 10,609,496, application No. 17/218,804, which is a continuation-in-part of application No. 17/169,604, filed on Feb. 8, 2021, now Pat. No. 11,363,362, which is a continuation of application No. PCT/CN2019/102382, filed on Aug. 24, 2019, and a continuation-in-part of application No. 16/922,965, filed on Jul. 7, 2020, now Pat. No. 11,115,751, which is a continuation of application No. PCT/CN2019/070545, filed on Jan. 5, 2019, said application No. 17/169,604 is a continuation-in-part of application No. 17/078,276, filed on Oct. 23, 2020, now Pat. No. 11,310,601, which is a continuation of application No. PCT/CN2019/070548, filed on Jan. 5, 2019.

(30) Foreign Application Priority Data

Jun. 15, 2018 (CN) ..... 201810624043.5
Jan. 5, 2019 (CN) ..... 201910009909.6

(51) Int. Cl.
*H04R 1/00* (2006.01)
*H04R 9/02* (2006.01)
*H04R 31/00* (2006.01)
*H04R 1/10* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(56) References Cited

U.S. PATENT DOCUMENTS

| | | | |
|---|---|---|---|
| 5,673,328 | A | 9/1997 | Wandl et al. |
| 5,734,132 | A | 3/1998 | Proni |
| 5,790,684 | A | 8/1998 | Niino et al. |
| 6,389,148 | B1 | 5/2002 | Yoo et al. |
| 6,850,138 | B1 | 2/2005 | Sakai |
| 8,691,792 | B2 | 11/2014 | Qi et al. |
| 9,226,075 | B2 | 12/2015 | Lee |
| 9,253,563 | B2 | 2/2016 | Fukuda |
| 9,742,887 | B2 | 8/2017 | Hosoi et al. |
| 10,897,677 | B2 | 1/2021 | Walraevens et al. |
| 11,310,601 | B2 | 4/2022 | Zheng et al. |
| 2003/0012395 | A1 | 1/2003 | Fukuda |
| 2003/0053651 | A1 | 3/2003 | Koura et al. |
| 2004/0105566 | A1 | 6/2004 | Matsunaga et al. |
| 2004/0131218 | A1 | 7/2004 | Dedieu et al. |
| 2006/0165246 | A1 | 7/2006 | Lee et al. |
| 2006/0262954 | A1 | 11/2006 | Lee et al. |
| 2007/0053536 | A1 | 3/2007 | Westerkull |
| 2009/0209806 | A1 | 8/2009 | Hakansson |
| 2009/0245553 | A1 | 10/2009 | Parker |
| 2009/0285417 | A1 | 11/2009 | Shin et al. |
| 2010/0046783 | A1 | 2/2010 | Huang |
| 2010/0329485 | A1 | 12/2010 | Fukuda |
| 2011/0280416 | A1 | 11/2011 | Abolfathi et al. |
| 2012/0020501 | A1 | 1/2012 | Lee |
| 2012/0281861 | A1 | 11/2012 | Lin |
| 2012/0286765 | A1 | 11/2012 | Heuvel et al. |
| 2012/0302822 | A1 | 11/2012 | Van Himbeeck et al. |
| 2013/0121513 | A1 | 5/2013 | Adachi |
| 2014/0064533 | A1 | 3/2014 | Kasic, II |
| 2014/0185822 | A1 | 7/2014 | Kunimoto et al. |
| 2014/0185837 | A1 | 7/2014 | Kunimoto et al. |
| 2014/0270293 | A1 | 9/2014 | Ruppersberg et al. |
| 2014/0355777 | A1 | 12/2014 | Nabata et al. |
| 2015/0208183 | A1 | 7/2015 | Bern |
| 2015/0264473 | A1 | 9/2015 | Fukuda |
| 2016/0127841 | A1 | 5/2016 | Horii |
| 2016/0234613 | A1 | 8/2016 | Westerkull |
| 2017/0164088 | A1 | 6/2017 | Fukuda |
| 2017/0295269 | A1 | 10/2017 | Hosoi et al. |
| 2017/0374479 | A1 | 12/2017 | Qi et al. |
| 2019/0014425 | A1 | 1/2019 | Liao et al. |
| 2020/0228903 | A1 | 7/2020 | Liao et al. |
| 2021/0076123 | A1 | 3/2021 | Zhang et al. |
| 2021/0092525 | A1 | 3/2021 | Zheng et al. |
| 2021/0116719 | A1 | 4/2021 | Wang et al. |
| 2021/0168493 | A1 | 6/2021 | Zheng et al. |

FOREIGN PATENT DOCUMENTS

| | | | | |
|---|---|---|---|---|
| CN | 201215970 | Y | 4/2009 | |
| CN | 102497612 | A | 6/2012 | |
| CN | 202435598 | U | 9/2012 | |
| CN | 202488645 | U | 10/2012 | |
| CN | 105007551 | A | 10/2015 | |
| CN | 105101019 | A | 11/2015 | |
| CN | 105101020 | A | 11/2015 | |
| CN | 105142077 | A | 12/2015 | |
| CN | 204887455 | U | 12/2015 | |
| CN | 105472511 | A | 4/2016 | |
| CN | 205142506 | U | 4/2016 | |
| CN | 106954152 | A | 7/2017 | |
| CN | 207070281 | U | 3/2018 | |
| CN | 107948883 | A | 4/2018 | |
| EP | 1404146 | A1 | 3/2004 | |
| EP | 1603362 | A1 | 12/2005 | |
| EP | 2234413 | * | 3/2010 | ..... H04R 25/00 |
| EP | 2800395 | A1 | 11/2014 | |
| EP | 3796670 | A1 | 3/2021 | |
| GB | 2454605 | A | 5/2009 | |
| JP | S5574290 | A | 6/1980 | |
| JP | 07007797 | A | 1/1995 | |
| JP | 2003264882 | A | 9/2003 | |
| JP | 2004064457 | A | 2/2004 | |
| JP | 2006025333 | A | 1/2006 | |
| JP | 2007129384 | A | 5/2007 | |
| JP | 2008017398 | A | 1/2008 | |
| JP | 2008054063 | A | 3/2008 | |
| JP | 2011160175 | A | 8/2011 | |
| JP | 2013102274 | A | 5/2013 | |
| JP | 2013243564 | A | 12/2013 | |
| KR | 20010111653 | A | 12/2001 | |
| KR | 20050030183 | A | 3/2005 | |

(56) References Cited

FOREIGN PATENT DOCUMENTS

| | | | |
|---|---|---|---|
| KR | 20070122104 | A | 12/2007 |
| KR | 20080101166 | A | 11/2008 |
| KR | 20090082999 | A | 8/2009 |
| KR | 20090091378 | A | 8/2009 |
| KR | 20100106836 | A | 10/2010 |
| KR | 200476572 | Y1 | 3/2015 |
| KR | 101849041 | B1 | 4/2018 |
| KR | 101934229 | B1 | 12/2018 |
| RU | 2359427 | C1 | 6/2009 |
| TW | 201820891 | A | 6/2018 |
| WO | 0219759 | A1 | 3/2002 |
| WO | 2006088410 | A1 | 8/2006 |
| WO | 2010110713 | A1 | 9/2010 |
| WO | 2010114195 | A1 | 10/2010 |

OTHER PUBLICATIONS

The Office Action in Russian Application No. 2021100590 dated Jul. 15, 2021, 12 pages.
Notice of Reasons for Rejection in Japanese Application No. 2020-088413 dated Aug. 3, 2021, 8 pages.
First Office Action in Chinese Application No. 201110438083.9 dated Sep. 27, 2012, 10 pages.
The Extended European Search Report in European Application No. 12860348.7 dated Apr. 28, 2015, 7 pages
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2015/086907 dated May 6, 2016, 10 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-14601S dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
Decision to Grant a Patent in Japanese Application No. 2018-146021 dated Jul. 21, 2020, 5 pages.
Notice of Preliminary Rejection in Republic of Korea Application No. 10-2018-7007115 dated May 20, 2021, 9 pages.
Written Opinion in PCT/CN2015/086907 dated May 6, 2016, 12 pages.
International Search Report in PCT/CN2019/102382 dated Nov. 22, 2019, 7 pages.
Written Opinion in PCT/CN2019/102382 dated Nov. 22, 2019, 10 pages.
Communication Pursuant to Article 94(3) EPC in European Application No. 15900783.9 dated Apr. 10, 2019, 6 pages.
Communication Pursuant to Article 94(3) EPC in European Application No. 15900793.9 dated Apr. 28, 2020, 9 pages.
International Search Report in PCT/CN2019/070545 dated Apr. 10, 2019, 6 pages.
Written Opinion in PCT/CN2019/070545 dated Apr. 10, 2019, 8 pages.
International Search Report in PCT/CN2019/070548 dated Mar. 25, 2019, 6 pages.
Written Opinion in PCT/CN2019/070548 dated Mar. 25, 2019, 7 pages.
The Extended European Search Report in European Application No. 19818634.8 dated Jun. 15, 2021, 14 pages.
The Extended European Search Report in European Application No. 19819601.6 dated May 3, 2021, 10 pages.
Anonymous, Tech Note: Understanding Exciters—Principles and Applications, Dayton Audio, 2014, 8 pages.
M. Gripper et al., Using the Callsign Acquisition Test (CAT) to Compare the Speech Intelligibility of Air Versus Bone Conduction, International Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Reasons for Rejection in Japanese Application No. 2020-569946 dated Feb. 21, 2022, 10 pages.
First Examination Report in Indian Application No. 202017054479 dated Dec. 20, 2021, 5 pages.
Notice of Reasons for Rejection in Japanese Application No. 2020569945 dated Feb. 21, 2022, 9 pages.
Notice of Preliminary Rejection in Korean Application No. 10-2021-7000929 dated Jan. 25, 2022, 13 pages.
Notice of Preliminary Rejection in Korean Application No. 10-2022-7003237 dated Apr. 13, 2022, 14 pages.

* cited by examiner

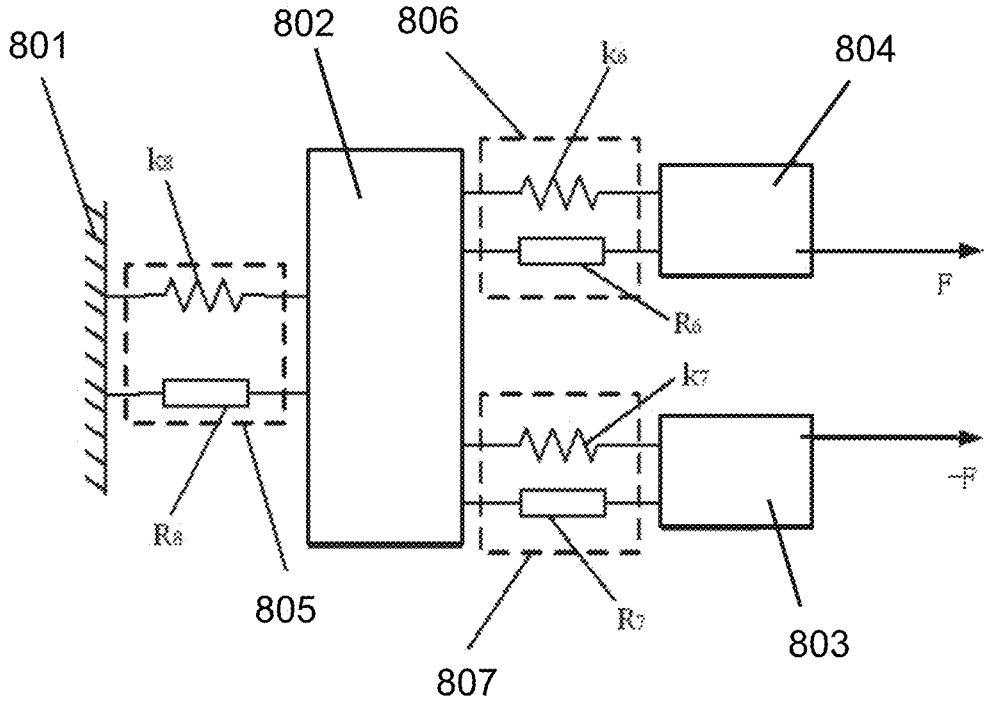
FIG. 8-A

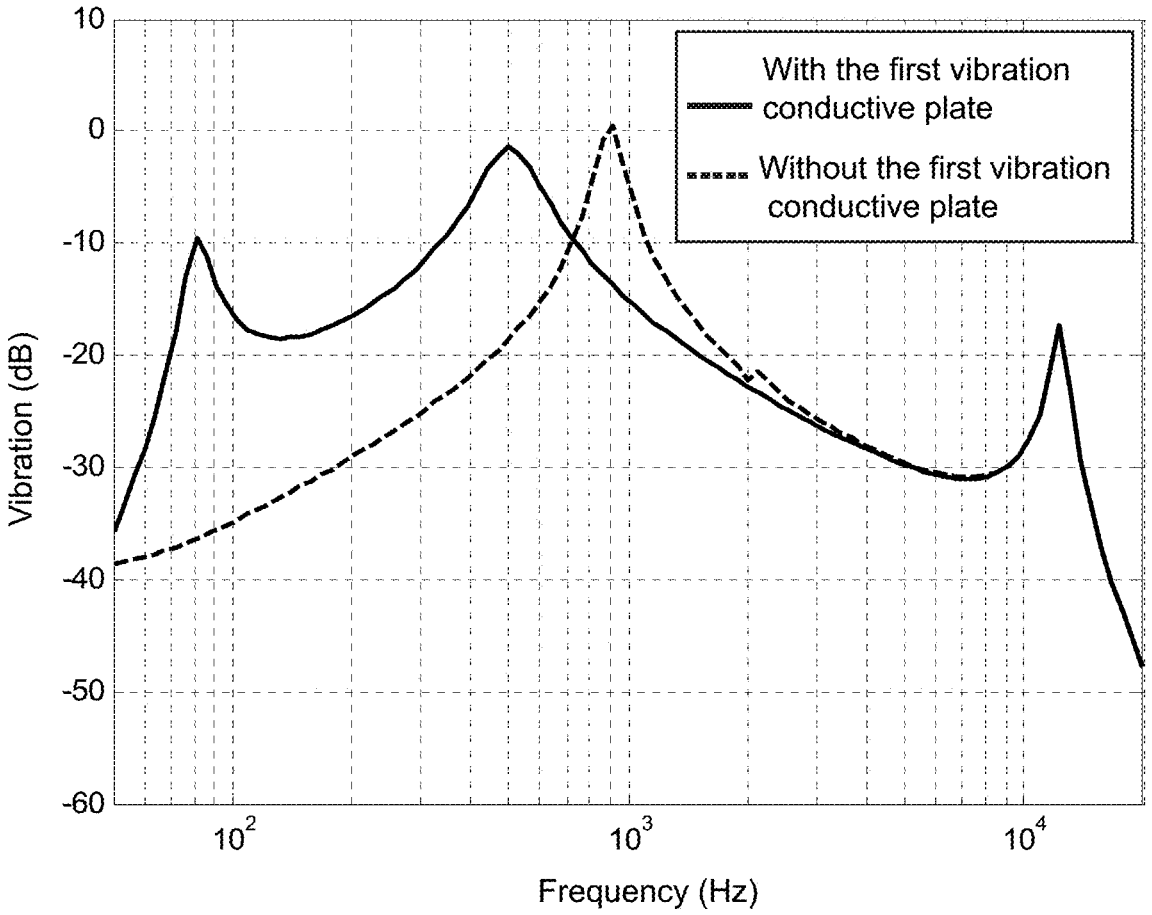
FIG. 8-B

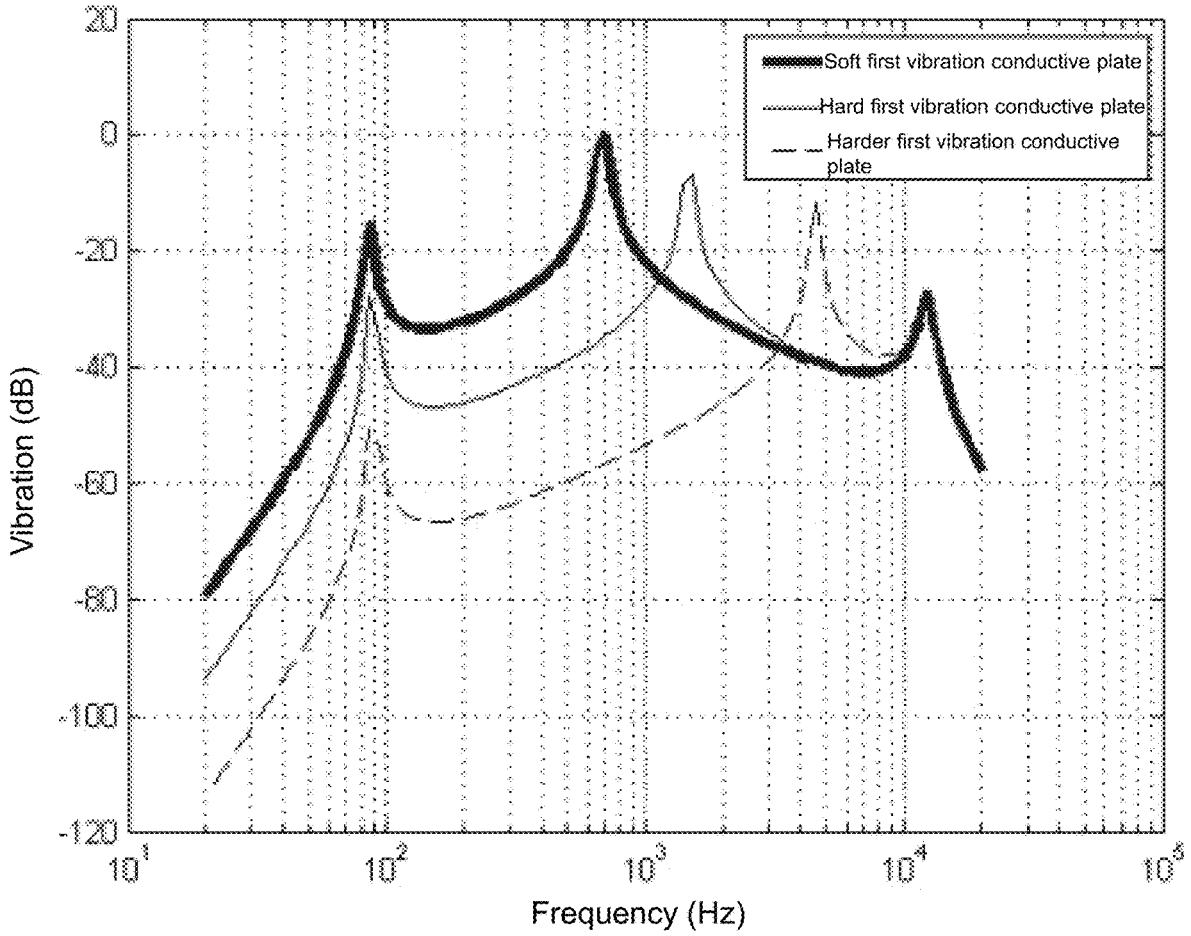
FIG. 8-C

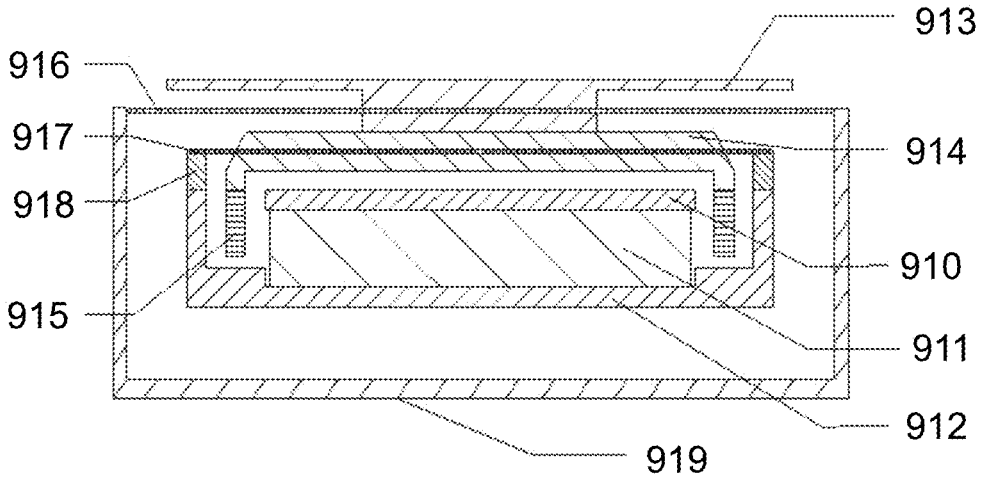
FIG. 9-A

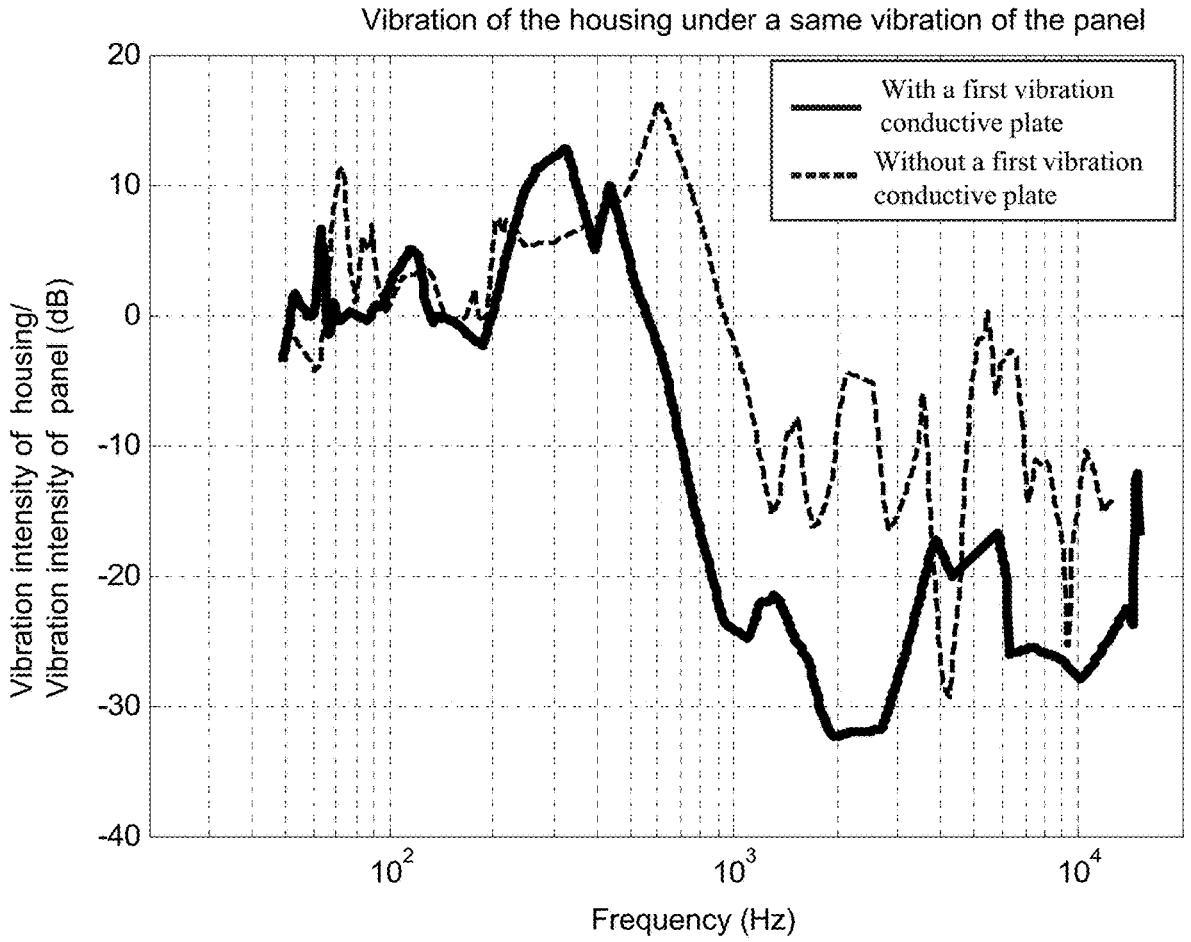
FIG. 9-B

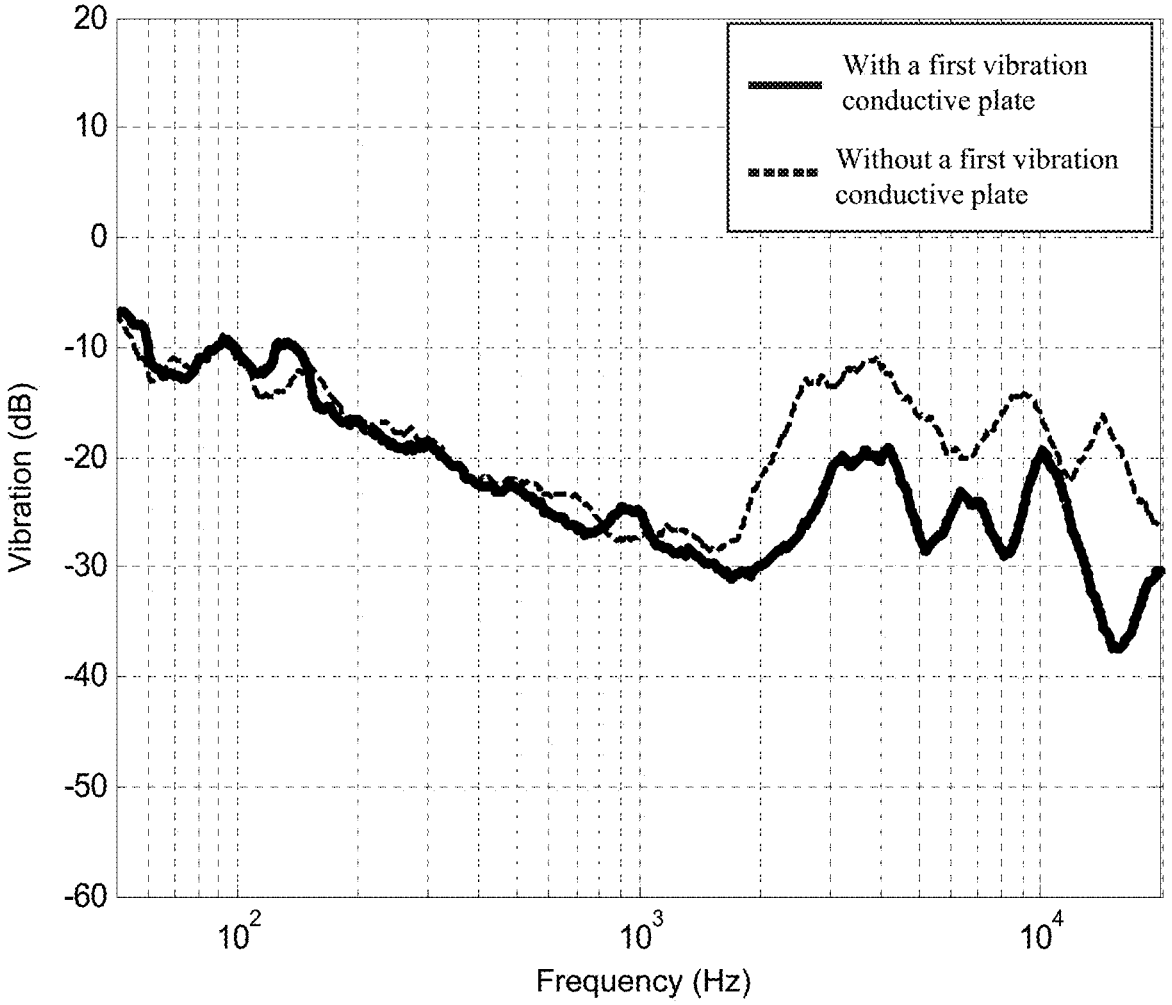
FIG. 9-C

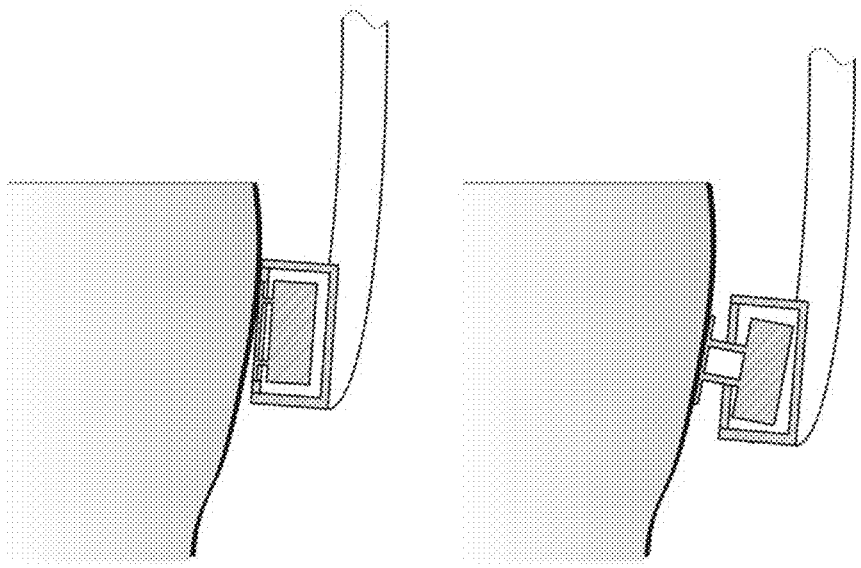
FIG. 11-A

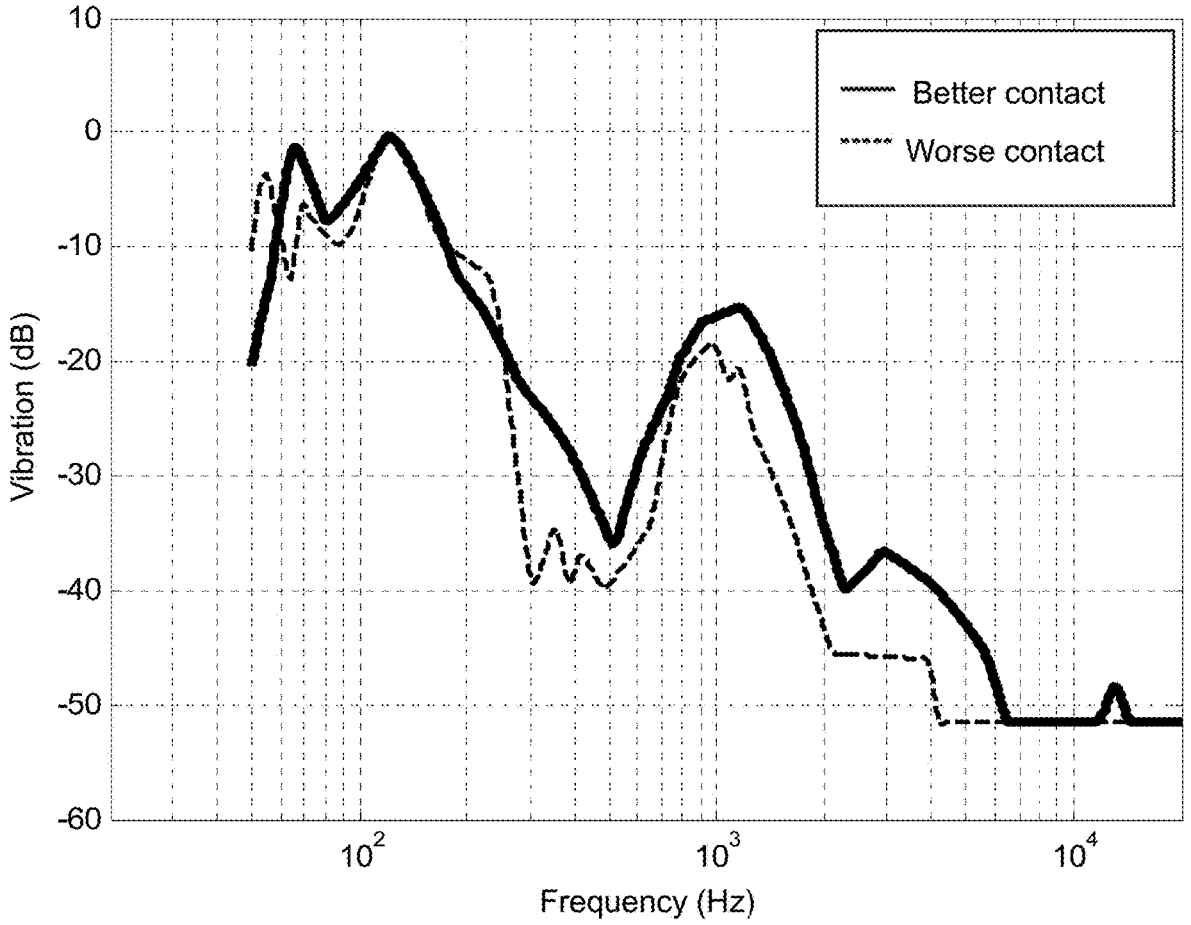
FIG. 11-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/169,604, filed on Feb. 8, 2021, which is a continuation-in-part application of International Patent Application No. PCT/CN2019/102382, filed on Aug. 24, 2019, which claims priority of Chinese Patent Application No. 201910009909.6, filed on Jan. 5, 2019; U.S. patent application Ser. No. 17/169,604, filed on Feb. 8, 2021 is also a continuation-in-part application of U.S. patent application Ser. No. 16/922,965, filed on Jul. 7, 2020, which is a continuation of International Patent Application No. PCT/CN2019/070545, filed on Jan. 5, 2019, which claims priority of Chinese Patent Application No. 201810624043.5, filed on Jun. 15, 2018; and U.S. patent application Ser. No. 17/169,604, filed on Feb. 8, 2021 is also a continuation-in-part application of U.S. patent application Ser. No. 17/078,276, filed on Oct. 23, 2020, which is a continuation of International Patent Application No. PCT/CN2019/070548, filed on Jan. 5, 2019, which claims priority of Chinese Patent Application No. 201810623408.2, filed on Jun. 15, 2018. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present disclosure is stated here, together with attached figures.

Figure 1:
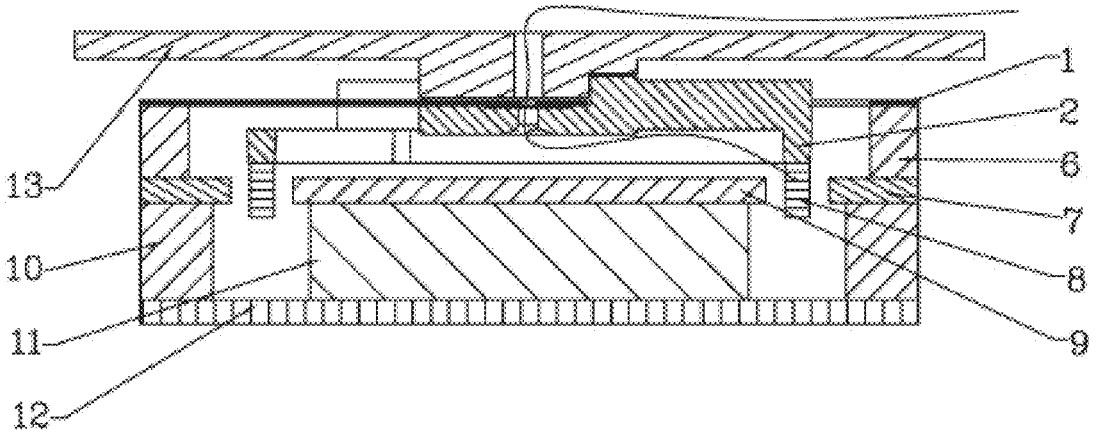
FIG. 1 illustrates a longitudinal section view of the bone conduction speaker in the present disclosure.
Figure 2:
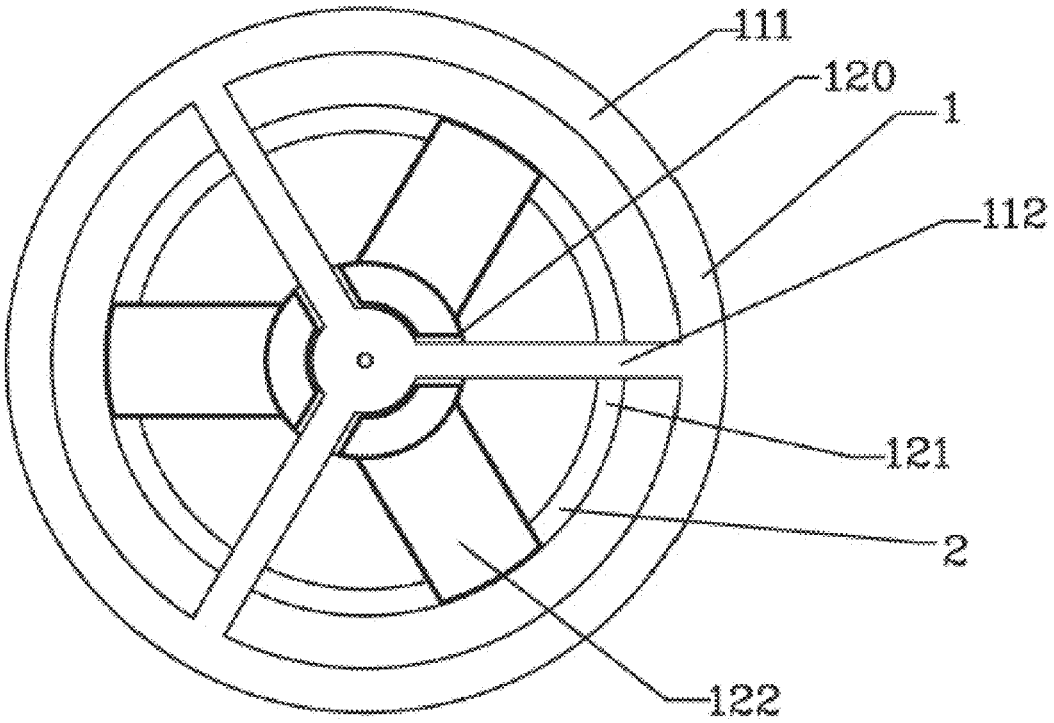
FIG. 2 illustrates a perspective view of the vibration parts in the bone conduction speaker in the present disclosure.
Figure 3:
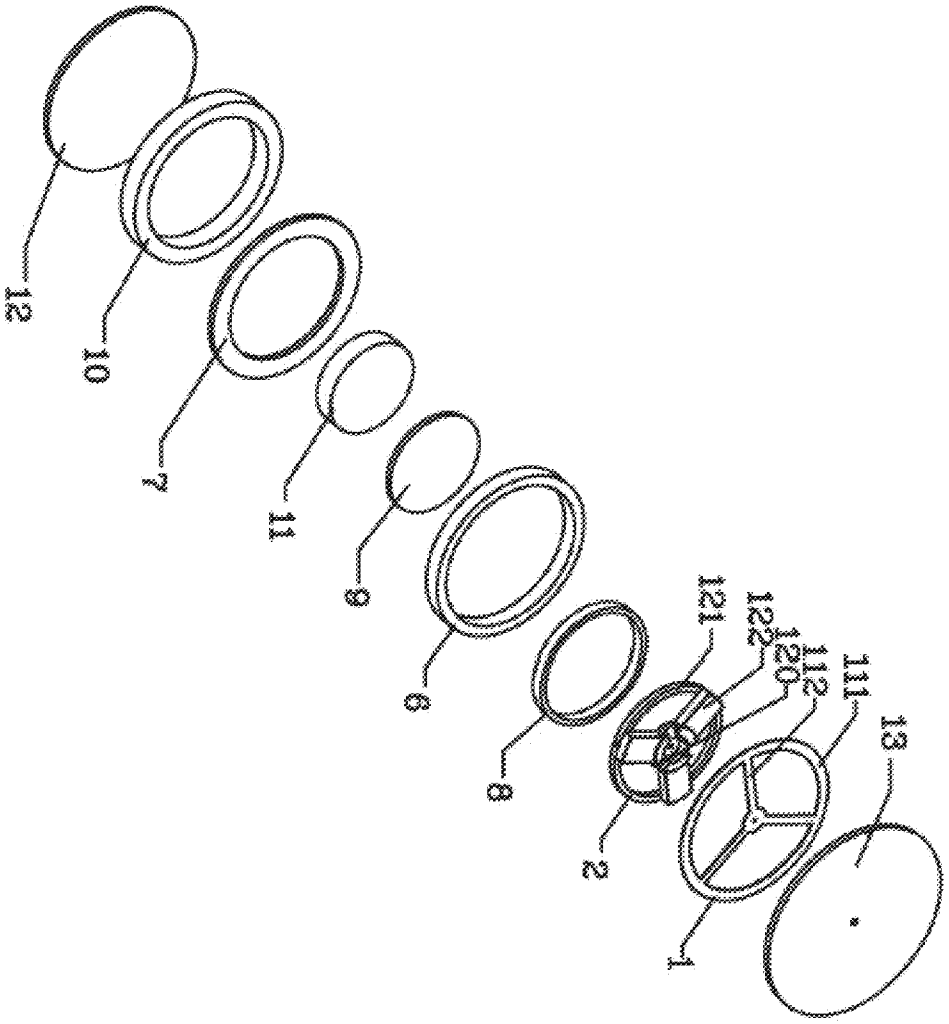
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
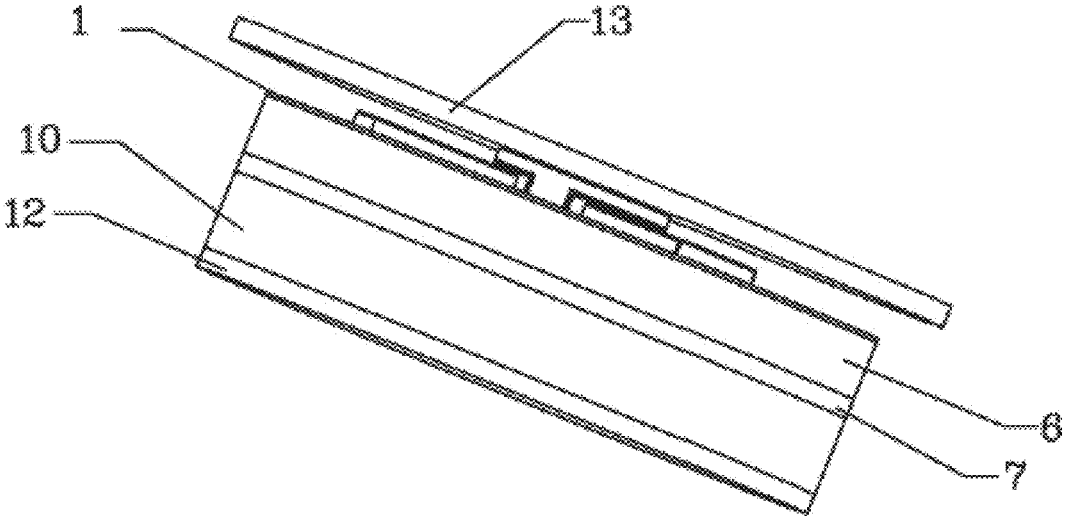
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
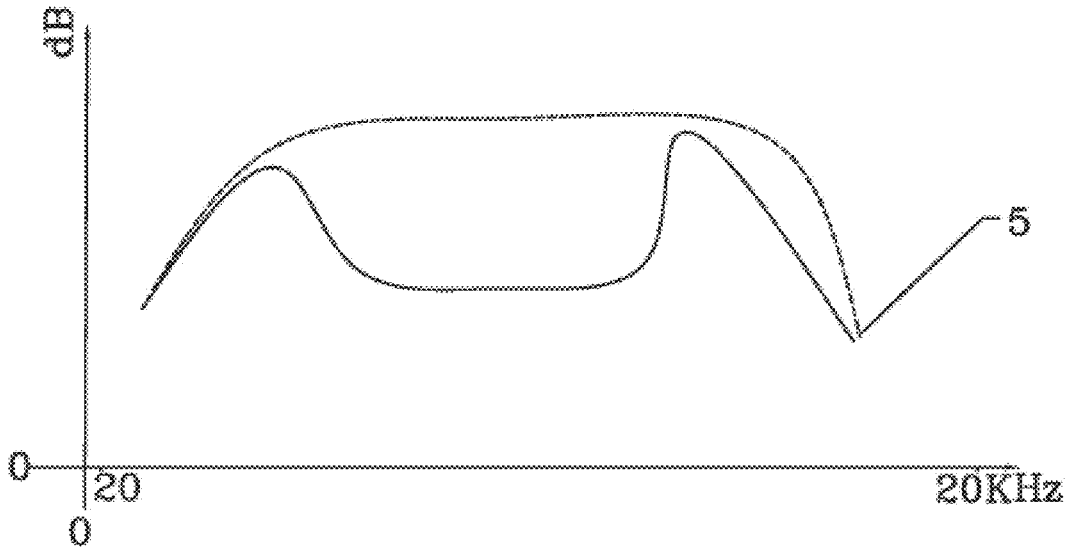
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz.

More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
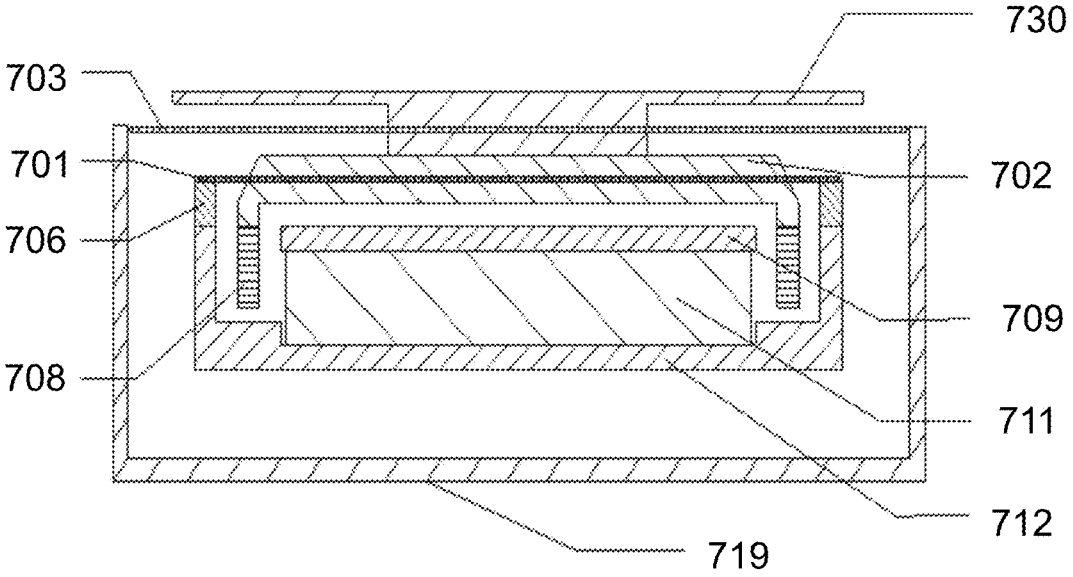
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x''_6+R_6(x_6-x_5)'+k_6(x_6-x_5)=F, \quad (1)$$

$$x''_7+R_7(x_7-x_5)'+k_7(x_7-x_5)=-F, \quad (2)$$

$$m_5x''_5-R_6(x_6-x_5)'-R_7(x_7-x_5)'+R_8x'_5+k_8x_5-k_6(x_6-x_5)-k_7(x_7-x_5)=0, \quad (3)$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is to displacement of the voice coil, and the amplitude of the panel 802 may be:

$$A_5=\frac{(-m_6\omega^2(jR_7\omega-k_7)+m_7\omega^2(jR_6\omega-k_6))}{\left(\begin{array}{c}(-m_5\omega^2-jR_8\omega+k_8)(-m_6\omega^2-jR_6\omega+k_6)(-m_7\omega^2-jR_7\omega+k_7)-\\ m_6\omega^2(-jR_6\omega+k_6)(-m_7\omega^2-jR_7\omega+k_7)-\\ m_7\omega^2(-jR_7\omega+k_7)(-m_6\omega^2-jR_6\omega+k_6)\end{array}\right)}-f_0, \quad (4)$$

wherein ω is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
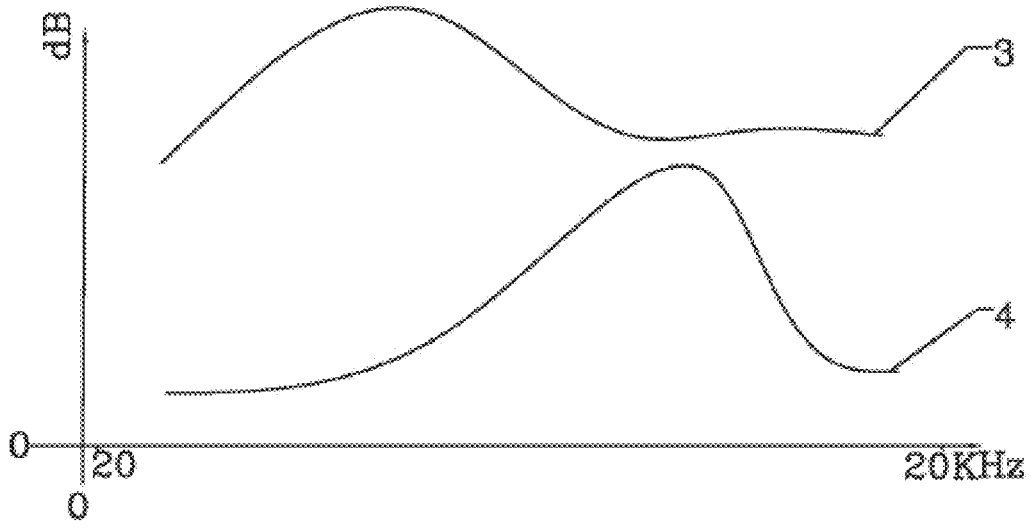
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2 N~1.5 N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
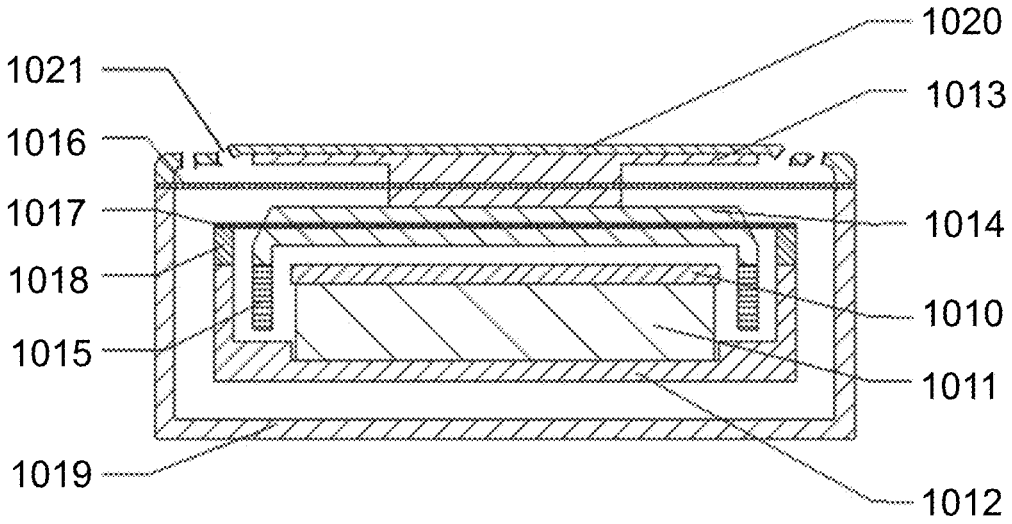
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
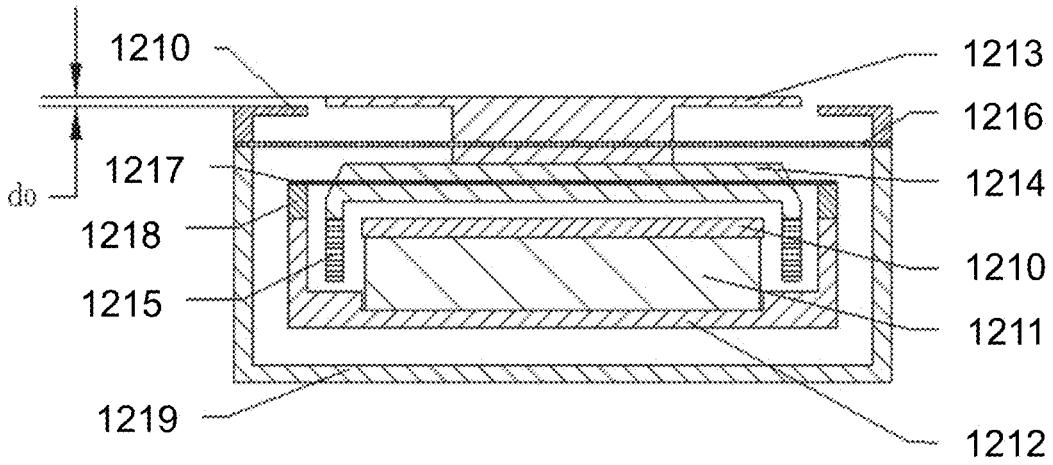
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
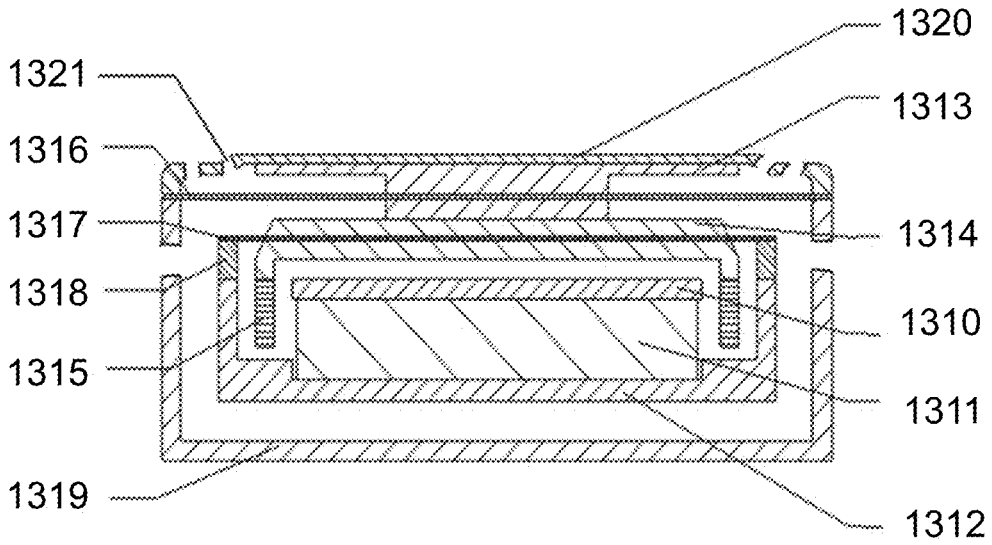
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

In some embodiments, the bone conduction speaker may include a button to facilitate a user of the bone conduction speaker to perform corresponding functions. The user may implement corresponding functions (e.g., pausing/playing music, answering a call, etc.) through the button. However, the setting of the button may affect the working state of a vibration device of the bone conduction speaker. For example, the button may reduce the volume generated by the vibration device. FIGS. 14-17 provide exemplary bone conduction speakers including at least one button, and the location of the at least one button in the bone conduction speaker is described.

Figure 14:
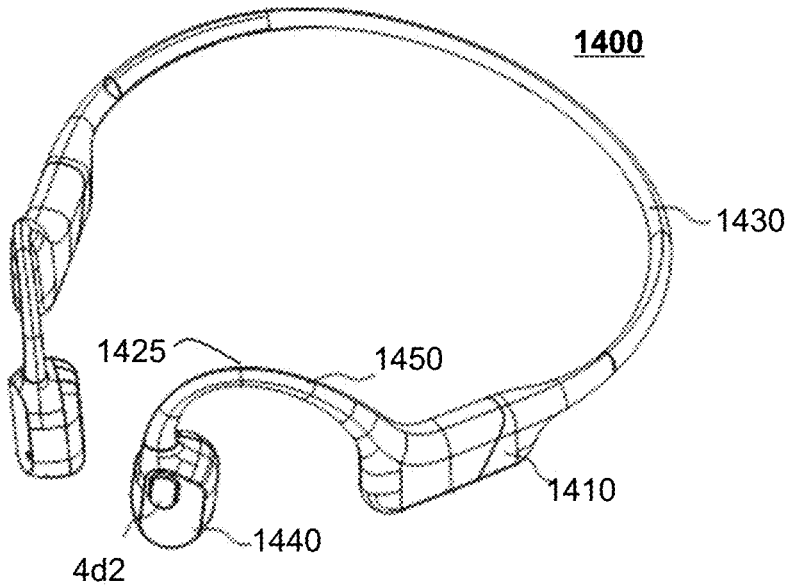
FIG. 14 is a schematic diagram illustrating an exemplary bone conduction speaker according to some embodiments of the present disclosure.
Figure 15:
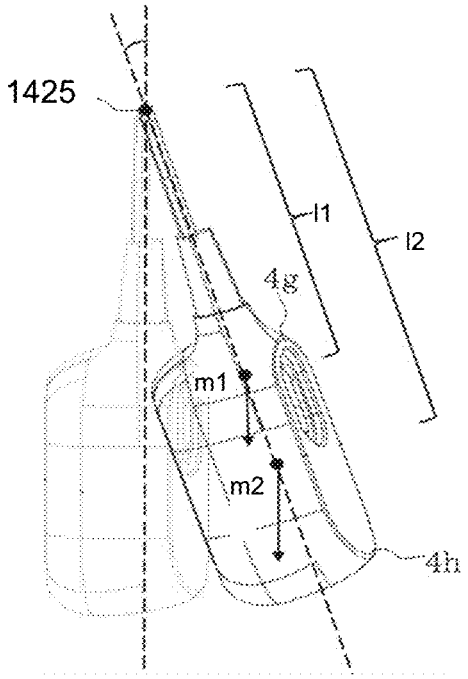
FIG. 15 is a schematic diagram illustrating a speaker assembly of an exemplary bone conduction speaker according to some embodiments of the present disclosure.

FIG. 14 is a schematic diagram illustrating an exemplary bone conduction speaker according to some embodiments of the present disclosure. FIG. 15 is a schematic diagram illustrating a speaker assembly of an exemplary bone conduction speaker according to some embodiments of the present disclosure. The bone conduction speaker 1400 may transmit a sound to an auditory system of a user of the bone conduction speaker 1400 via a bone conduction mode, an air conduction mode, or the like, or any combination thereof so that the user can hear the sound. In some embodiments, the bone conduction speaker 1400 may include a supporting connector 1410 and at least one vibration device 1440 disposed on the supporting connector 1410. In some embodiments, the supporting connector 1410 may include an ear hook 1450. Specifically, the supporting connector 1410 may include two ear hooks 1450 and a rear hook 1430, and the rear hook 1430 may be connected to the two ear hooks 1450 and disposed between the two ear hooks 1450. When the bone conduction speaker 1400 is worn by the user, the two ear hooks 1450 may correspond to the left ear and the right ear of the user, respectively, and the rear hook 1430 may correspond to the back of the head of the user. The ear hook 1450 may be configured to contact with the head of the user, and one or more contact points (e.g., one or more points located near a top point 1425) of the ear hook 1450 and the head of the user may include a vibration fulcrum of the speaker assembly 1440 when the speaker assembly 1440 vibrates.

In some embodiments, the vibration of the speaker assembly 1440 may be regarded as a reciprocating swing movement. The top point 1425 of the ear hook 1450 may be regarded as a fixed point of the reciprocating swing movement, and a portion of the ear hook 1450 between the top point 1425 of the ear hook 1450 and the speaker assembly 1440 may be regarded as an arm of the reciprocating swing movement. The fixed point of the reciprocating swing movement may be regarded as the vibration fulcrum. In some embodiments, a swing amplitude (i.e., vibration acceleration) of the speaker assembly 1440 may be a positive correlation with a volume generated by the speaker assembly 1440. A mass distribution of the speaker assembly 1440 may affect the amplitude of the swing amplitude of the speaker assembly 1440, and further affect the volume generated by the speaker assembly 1440.

In some embodiments, the speaker assembly 1440 may include a headphone core, a housing (e.g., housing 1620 shown in FIGS. 16 and 17) configured to accommodate the headphone core, a vibration device (also referred to as "speaker module" hereinafter) (not shown in the figure), and at least one button 4*d*. For example, the speaker module may include a first speaker module and a second speaker module, which are disposed within the speaker assembly 1440. The first speaker module may be disposed on the speaker assembly 1440 disposed at a first end of the bone conduction speaker 1400. The second speaker module may be disposed on the speaker assembly 1440 disposed at a second end of the bone conduction speaker 1400. In some embodiments, the speaker module may refer to all components of the speaker assembly 1440 other than the button 4*d*. For example, the speaker module may refer to the headphone core, the housing, and one or more units (e.g., a microphone, a flexible circuit board, a bonding pad, etc.) accommodated in the housing.

In some embodiments, the supporting connector 1410 may be configured to accommodate a control circuit (not shown in the figure) or a battery (not shown in the figure). The control circuit or the battery may drive the headphone core to vibrate to generate a sound.

In some embodiments, the button 4*d* may be configured for user operation. For example, a user may operate the button 4*d* to perform a function such as a pause/start function, a recording function, an answering a call function, or the like, or any combination thereof.

In some embodiments, the button 4*d* may implement different interactive functions based on a user's operation instruction. For example, the user may click the button 4*d* once to pause/start e.g., music, recording, etc. As another example, the user may click the button 4*d* twice to answer a call. As a further example, the user may regularly click the button 4*d* (e.g., click the button 4*d* once every second, click the button 4*d* twice in total) to activate a recording function of the bone conduction speaker 1400. In some embodiments, the user's operation instruction may include a click, a slid, a scroll, or the like, or any combination thereof. For example, the user may slide up and down on a surface of the button 4*d* to realize a function of switching songs.

In some application scenarios, the speaker assembly 1440 may include at least two buttons 4*d*, and the at least two buttons 4*d* may correspond to a first ear hook (e.g., a left ear hook) of the two ear hooks 50 and the second ear hook (e.g., a right ear hook) of the two ear hooks 1450, respectively. The user may use the left and right hands to operate the at least two buttons 4*d*, respectively, thereby improving the user's experience.

In some embodiments, to further improve the user's human-computer interaction experience, the human-computer interaction function may be allocated to the buttons 4*d* corresponding to the first ear hook and the second ear hook, respectively. The user may operate each of the at least two buttons 4*d* to realize corresponding functions. For example, the user may click the button 4*d* corresponding to the first ear hook once to activate a recording function, and/or click the button 4*d* corresponding to the first ear hook again to turn off the recording function. As another example, the user may click the button 4*d* corresponding to the first ear hook twice to realize the pause/play function. As another example, the user may click the button 4*d* corresponding to the second ear hook twice to answer a call or realize a next/previous song function when music is playing and there is no call.

In some embodiments, the aforementioned functions corresponding to the at least two buttons 4*d* may be determined by the user. For example, the user may assign the pause/play function executed by the button 4*d* corresponding to the first ear hook to the button 4*d* corresponding to the second ear hook by setting an application software.

As another example, the user may determine that the function of answering a call function executed by performing an operation on the button 4*d* corresponding to the first ear hook may be replaced by performing an operation on the button 4*d* corresponding to the second ear hook. In some embodiments, for a specific function, the user may determine the user's operation instruction (e.g., a number of clicking the button 4*d*, a sliding gesture, etc.) by setting the application software to perform the function. For example, a user's operation instruction corresponding to the answering a call function may be determined as click the button 4*d* twice instead of once. As another example, a user's operation instruction corresponding to the next/previous song function may be determined as click the button 4*d* three times instead of twice. The user may determine the user's operation instruction based on a habit of the user, thereby improving the user experience.

In some embodiments, the above-mentioned interaction function may be not unique, which may be determined according to functions commonly used by the user. For example, the button 4*d* may be used to perform a call rejection function, a text messages read function, or the like, or any combination thereof. The user may determine the interaction function and/or the user's operation instruction, thereby meeting different needs.

In some embodiments, a distance between a center of the button 4*d* and the vibration fulcrum may be not greater than a distance between a center of the speaker module and the vibration fulcrum, thereby improving the vibration acceleration of the speaker assembly 1440 and the volume generated by the vibration of the speaker assembly 1440.

In some embodiments, the center of the button 4*d* may include a center of mass m1 or a centroid g1. A first distance l1 may be formed between the center of mass m1 or the centroid g1 of the button 4*d* and the top point 1425 (i.e., the vibration fulcrum) of the ear hook 1450. A second distance l2 may be formed between a center of mass m2 or a centroid g2 of the speaker module and the top point 1425 of the ear hook 1450. It should be noted that the center of mass and the centroid (e.g., the center of mass m2 and the centroid g2) of the speaker module may be replaced by a center of mass and a centroid of the housing, respectively.

In some embodiments, a mass distribution of the button 4*d* and/or the speaker module may be relatively uniform. The center of mass m1 of the button 4*d* may coincide with the centroid g2 of the button 4*d*. The center of mass m2 of the speaker module may coincide with the centroid g2 of the speaker module.

In some embodiments, the vibration of the speaker assembly 1440 may be indicated by a ratio of the first distance l1 to the second distance l2, and a ratio k of a mass of the button 4*d* to a mass of the speaker module.

Specifically, according to the dynamic principle, when the button 4*d* is arranged at a far end 4*h* of the top point 1425 of the ear hook 1450 away from the top point 1425 of the ear hook 1450, a vibration acceleration of the speaker assembly 1440 may be less than a vibration acceleration of the speaker assembly 1440 when the button 4*d* is arranged at a proximal end 4*g* of the top point 1425 of the ear hook 1450, thereby reducing the volume generated by the speaker assembly 1440. When the mass of the button 4*d* is constant, the vibration acceleration of the speaker assembly 1440 may be decreased as the ratio of the first distance l1 to the second distance l2 increases, thereby reducing the volume generated by the speaker assembly 1440. When the ratio of the first distance l1 to the second distance l2 is constant, the vibration acceleration of the speaker assembly 1440 may be decreased as the mass of the button 4*d* increases, thereby reducing the volume generated by the speaker assembly 1440. The volume generated by the speaker assembly 1440 may be determined and/or adjusted within a range that the ear of the user can recognize by adjusting the ratio of the first distance l1 to the second distance l2 and/or the mass ratio k of the button 4*d* to the mass of the speaker module.

In some embodiments, the ratio of the first distance l1 to the second distance l2 may not be greater than a first ratio threshold. For example, the ratio of the first distance l1 to the second distance l2 may not be greater than 1.

Specifically, when the ratio of the first distance l1 to the second distance l2 is equal to 1, the center of mass m1 and centroid g1 of the button 4*d* may coincide with the center of the mass m2 and the centroid g2 of the speaker module, respectively, and the button 4*d* may be disposed on a center of the speaker assembly 1440. When the ratio of the first distance l1 to the second distance l2 is less than 1, the center of mass m1 or the centroid g1 of the button 4*d* may be closer to the top point 1425 of the ear hook 1450 with respect to the center of mass m2 or the centroid g2 of the speaker module, and the button 4*d* may be disposed on a proximal end close to the top point 1425 of the ear hook 1450. The less the ratio of the first distance l1 to the second distance l2 is, the closer the center of mass m1 or centroid g1 of the button 4*d* to the top point 1425 of the ear hook 1450 relative to the center of mass m2 or centroid g2 of the speaker module is.

In some embodiments, the ratio of the first distance l1 to the second distance l2 may be not greater than a third ratio threshold. For example, the ratio of the first distance l1 to the second distance l2 may not be greater than 0.95, and the button 4*d* may be closer to the top point 1425 of the ear hook 1450. In some embodiments, the ratio of the first distance l1 to the second distance l2 may be 0.9, 0.8, 0.7, 0.6, 0.5, etc., which may be determined according to actual needs and is not limited herein.

Further, when the ratio of the first distance l1 to the second distance l2 satisfies a range aforementioned, the ratio of the mass of the button 4*d* to the mass of the speaker module may not be greater than a second ratio threshold. For example, the ratio of the mass of the button 4*d* to the mass of the speaker module may not be greater than 0.3. For example, the ratio of the mass of the button 4*d* to the mass of the speaker module may not be greater than 0.29, 0.23, 0.17, 0.1, 0.06, 0.04, etc., which are not limited herein.

It should be noted that the center of mass m1 of the button 4*d* may coincide with the centroid g1 of the button 4*d* (not shown in the figure), that is, the center of mass m1 of the button 4*d* and the centroid g1 of the button 4*d* may locate at a same point. When the mass distribution of the button 4*d* and the speaker module is relatively uniform, the center of mass m2 of the speaker module may coincide with the centroid g2 (not shown in the figure) of the speaker module.

In some embodiments, the center of mass m1 may not coincide with the centroid g1 of the button 4*d*. A structure of the button 4*d* may be relatively simple and/or regular, the centroid g1 of the button 4*d* may be calculated relatively easily, the centroid g1 may be regarded as a reference point. The center of mass m2 may not coincide with the centroid g2 of the speaker module. One or more units (e.g., a microphone, a flexible circuit board, a bonding pad, etc.) of the speaker module may be made of different materials, the mass distribution of the speaker module may be not uniform, and the one or more units may have an irregular shape, the center of mass m2 of the speaker module may be regarded as a reference point.

In some application scenarios, the first distance l1 may be formed between the centroid g1 of the button 4*d* and the top point 1425 of the ear hook 1450, and the second distance l2 may be formed between the center of mass m2 of the speaker module and the top point 1425 of the ear hook 1450. The vibration of the button 4*d* in the speaker assembly 1440 may be indicated by the ratio of the first distance l1 to the second distance l2, and the ratio k of a mass of the button 4*d* to the mass of the speaker module. Specifically, when the mass of the button 4*d* is constant, the vibration acceleration of the speaker assembly 1440 may be decreased as the ratio of the first distance l1 to the second distance l2 increases, thereby reducing the volume generated by the speaker assembly 1440. When the ratio of the first distance l1 to the second distance l2 is constant, the vibration acceleration of the speaker assembly 1440 may be decreased as the mass of the button 4*d* increases, thereby reducing the volume generated by the speaker assembly 1440. The volume generated by the speaker assembly 1440 may be determined and/or adjusted within a range that the ear can recognize by adjusting the ratio of the first distance l1 to the second distance l2 and/or the mass ratio k of the button 4*d* to the mass of the speaker module.

In some embodiments, the ratio of the first distance l1 to the second distance l2 may not be greater than a first ratio threshold. For example, the ratio of the first distance l1 to the second distance l2 may not be greater than 1.

Specifically, when the ratio of the first distance l1 to the second distance l2 is equal to 1, the centroid g1 of the button 4*d* may coincide with the center of mass the m2, and the button 4*d* may be disposed on a center of the speaker assembly 1440. When the ratio of the first distance l1 to the second distance l2 is less than 1, the centroid g1 of the button 4*d* may be closer to the top point 1425 of the ear hook 1450 with respect to the center of the mass m2 of the speaker module, and the button 4*d* may be disposed on the proximal end close to the top point 1425 of the ear hook 1450. The less the ratio of the first distance l1 to the second distance l2 is, the closer the center of mass m1 or centroid g1 of the button 4*d* to the top point 1425 of the ear hook 1450 relative to the center of mass m2 or centroid g2 of the speaker module.

In some embodiments, the ratio of the first distance l1 to the second distance l2 may be not greater than a third ratio threshold. For example, the ratio of the first distance l1 to the second distance l2 may not be greater than 0.95, and the button 4*d* may be closer to the top point 1425 of the ear hook 1450. In some embodiments, the ratio of the first distance l1 to the second distance l2 may be 0.9, 0.8, 0.7, 0.6, 0.5, etc., which may be determined according to actual needs and is not limited herein.

Further, when the ratio of the first distance l1 to the second distance l2 satisfies a range aforementioned, the ratio of the mass of the button 4*d* to the mass of the speaker module may not be greater than a second ratio threshold. For example, the ratio of the mass of the button 4*d* to the mass of the speaker module may not be greater than 0.3. For example, the ratio of the mass of the button 4*d* to the mass of the speaker module may not be greater than 0.29, 0.23, 0.17, 0.1, 0.06, 0.04, etc., which are not limited herein.

It should be noted that, in some embodiments, the centroid g2 of the speaker module be regarded as the reference point, which may be similar to the foregoing mentioned embodiments, which is not be repeated herein.

Figure 16:
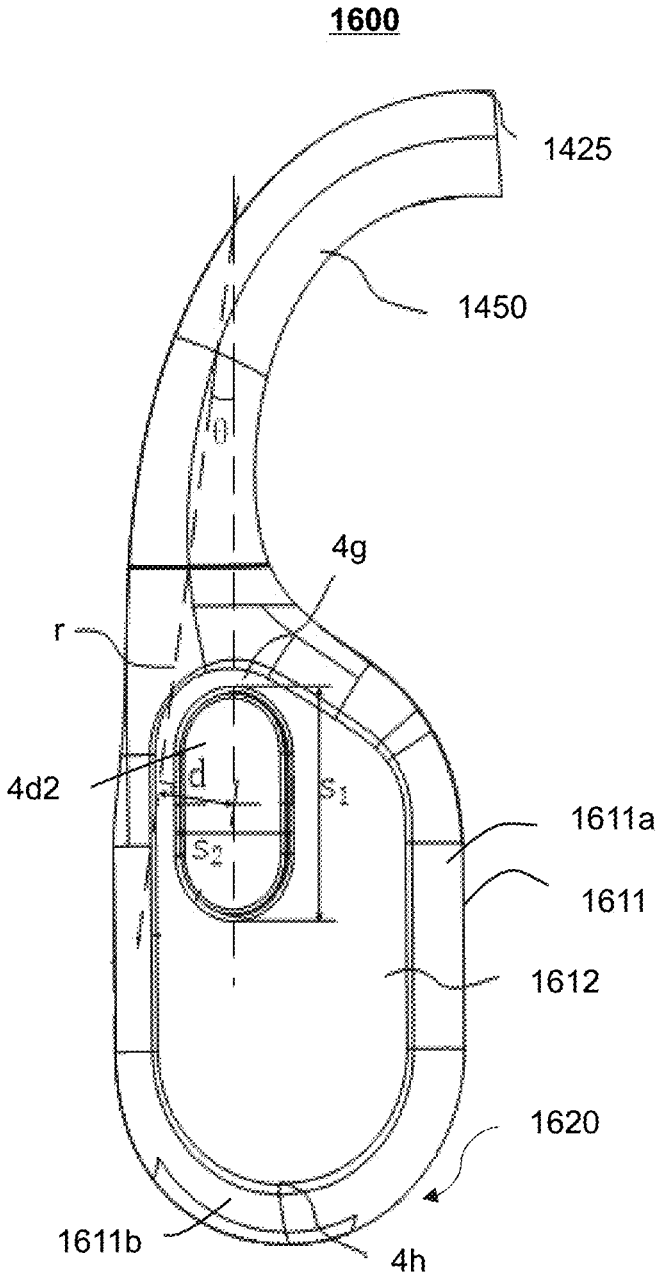
FIG. 16 is a schematic structural diagram illustrating a speaker assembly of a bone conduction speaker according to some embodiments of the present disclosure.

FIG. 16 is a schematic structural diagram illustrating a speaker assembly of a bone conduction speaker according to some embodiments of the present disclosure. In some embodiments, a speaker module of the speaker assembly 1600 may include a headphone core and a housing 1620. The headphone core may be configured to generate a sound and the housing 1620 may be configured to accommodate the headphone core.

In some embodiments, the housing 1620 may include an outer side wall 1612 and a peripheral side wall 1611. The peripheral side wall 1611 may be connected to and surrounding the outer side wall 1612. When a user wears the bone conduction speaker, the side opposite to the outer side wall 1612 (which is behind the outer side wall 1612 in FIG. 16 and not shown) may be in contact with the human head, and the outer side wall 612 may be located away from the human head. In some embodiments, the housing 1620 may include a cavity configured to accommodates the headphone core.

In some embodiments, the peripheral side wall 1611 may include a first peripheral side wall 1611*a* arranged along a length direction of the outer side wall 1612 and a second peripheral side wall 611*b* arranged along a width direction of the outer side wall 1612. The outer side wall 1612 and the peripheral side wall 1611 may be connected and form the cavity with an open end, and the cavity may be configured to accommodate the headphone core.

In some embodiments, a count (or a number) of the first peripheral side wall 1611*a* and/or the second peripheral side wall 1611*b* may be two. The first peripheral side wall 1611*a* and the second peripheral side wall 1611*b* may be enclosed in sequence. When the user wears the bone conduction speaker, the two first peripheral side walls 1611*a* may face a front side and a back side of the user's head, respectively. The two second peripheral side walls 1611*b* may face an upper side and a lower side of the user's head, respectively.

In some embodiments, the outer side wall 1612 may cover an end of the first peripheral side wall 1611*a* and the second peripheral side wall 1611*b* after the first peripheral side wall 1611*a* and the second peripheral side wall 1611*b* are enclosed. The housing 1620 with an open end and a closed end may be formed and configured to accommodate the headphone core.

In some embodiments, a shape enclosed by the first peripheral side wall 1611*a* and the second peripheral side wall 1611*b* may be not limited. The shape enclosed by the first peripheral side wall 1611*a* and the second peripheral side wall 1611*b* may include any shape suitable for wearing on the user's head, such as a rectangle, a square, a circle, an ellipse, etc.

In some embodiments, the shape enclosed by the first peripheral side wall 1611*a* and the second peripheral side wall 1611*b* may conform to the principle of ergonomics, thereby improving the wearing experience of the user. In some embodiments, a height of the first peripheral side wall 1611*a* and a height of the second peripheral side wall 1611*b* may be the same or different. When heights of two successively connected peripheral side walls 1611 are not the same, a protruding part of the peripheral side wall 1611 may not affect the wearing and/or operation of the user.

Figure 17:
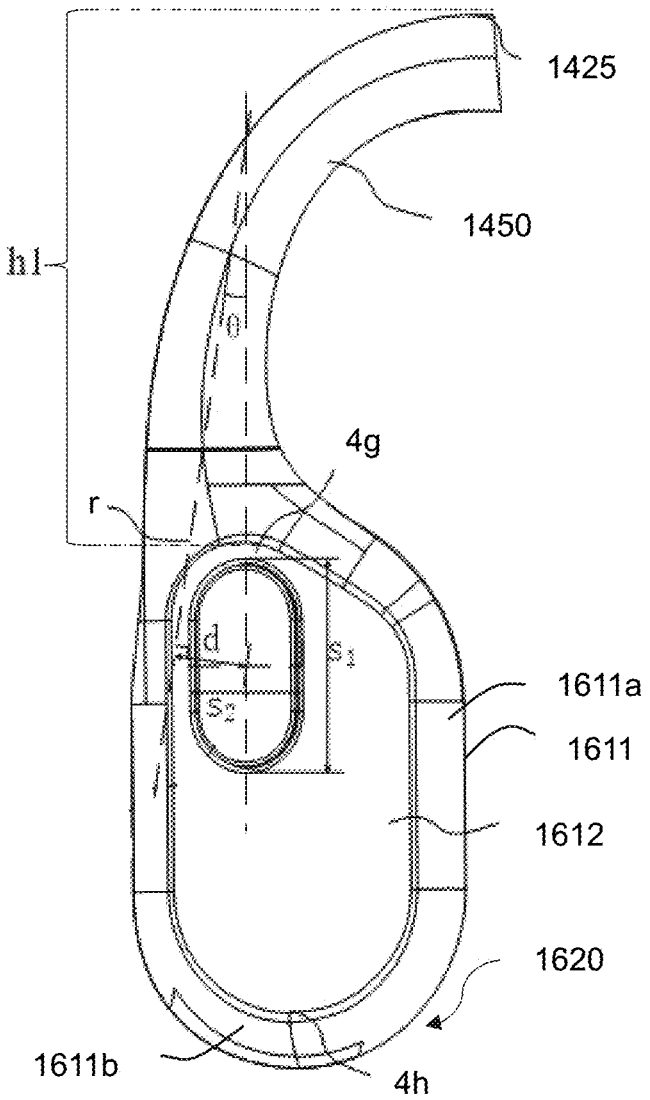
FIG. 17 is a schematic diagram illustrating a distance h1 according to some embodiments of the present disclosure.
Figure 18:
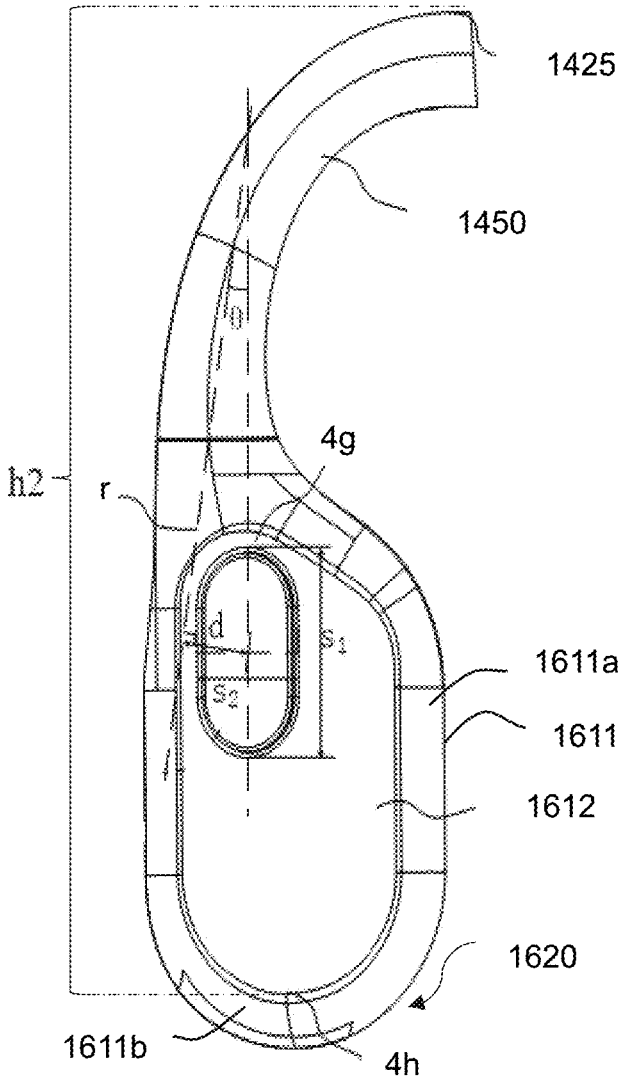
FIG. 18 is a schematic diagram illustrating a distance h2 according to some embodiments of the present disclosure.
Figure 19:
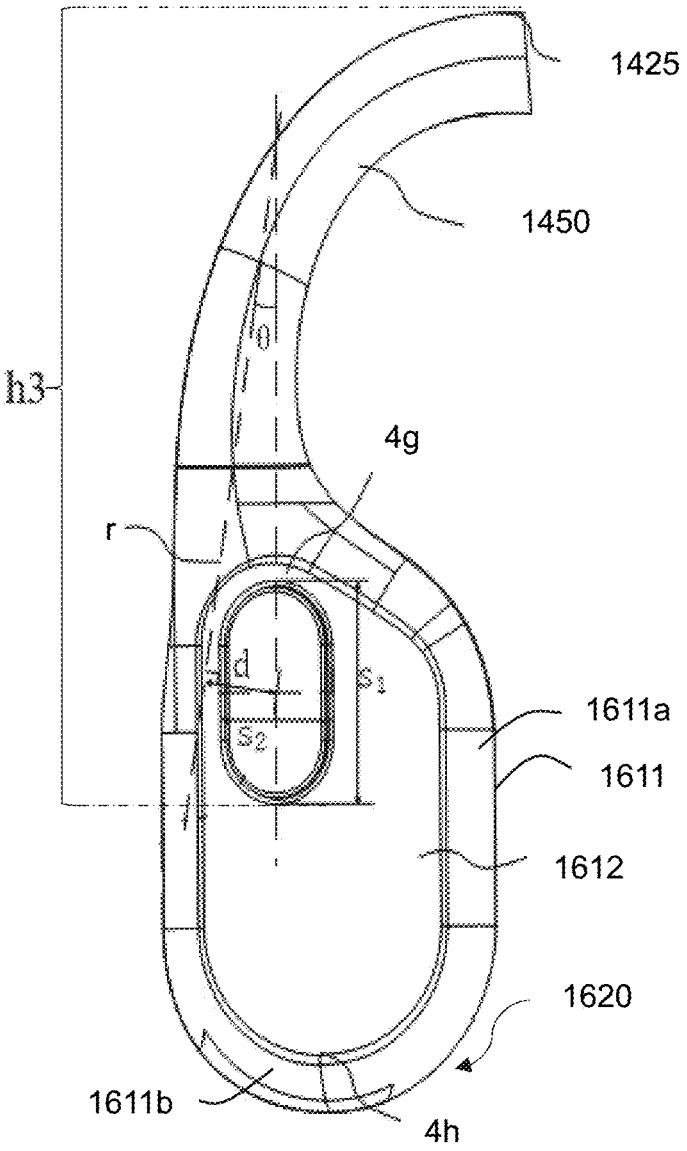
FIG. 19 is a schematic diagram illustrating a distance h3 according to some embodiments of the present disclosure.

FIG. 17 is a schematic diagram illustrating a distance h1 according to some embodiments of the present disclosure. FIG. 18 is a schematic diagram illustrating a distance h2 according to some embodiments of the present disclosure. FIG. 19 is a schematic diagram illustrating a distance h3 according to some embodiments of the present disclosure. In some embodiments, an outer side wall 1612 may be disposed on an end enclosed by a first peripheral side wall 1611*a* and a second peripheral side wall 1611*b*. When a user wears a bone conduction speaker, the outer side wall 1612 may be located at an end of the first peripheral side wall 1611*a* and the second peripheral side wall 611*b* away from the user's head. In some embodiments, the outer side wall 1612 may include a proximal end point and a distal end point. The proximal end point and the distal end point may be located on a contour connecting the outer side wall 1612 with the first peripheral side wall 1611*a* and the second peripheral side wall 1611*b*, respectively. The proximal end point may be opposite to the distal end point on the contour. In some embodiments, the distance h1 between the proximal end point and a vibration fulcrum may be relatively short, and the proximal end may be referred to as at a top position. The distance h2 between the distal end point and the vibration fulcrum may be relatively long, and the distal end point may be referred to as at a bottom position. The distance h3 between a midpoint of a line connecting the proximal end point and the distal end point and the vibration fulcrum may be between h1 and h2, and the midpoint may be referred to as at a middle position.

In some embodiments, the button 4*d* may be located in the middle position of the outer side wall 1612. In some embodiments, the button 4*d* may be located between the middle position and the top position of the outer side wall 1612.

Figure 20:
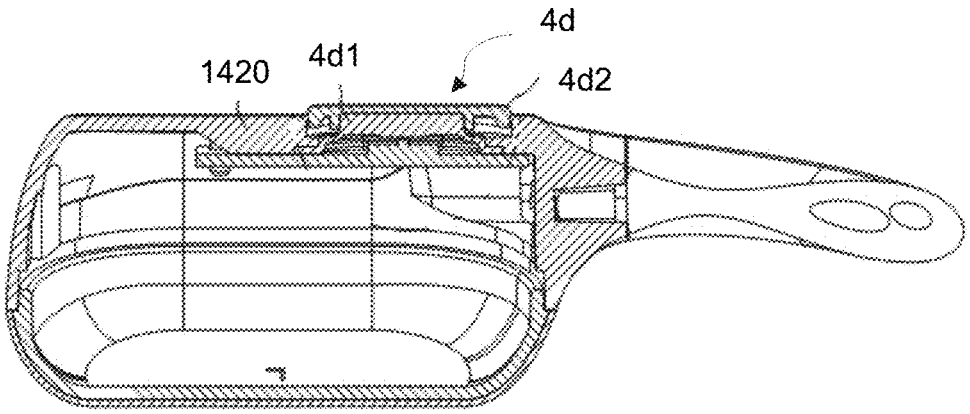
FIG. 20 is a schematic diagram illustrating a cross-sectional view of a partial structure of an exemplary speaker assembly according to some embodiments of the present disclosure.

FIG. 20 is a schematic diagram illustrating a cross-sectional view of a partial structure of an exemplary speaker assembly according to some embodiments of the present disclosure. As shown in FIG. 20, a button 4*d* may include an elastic bearing 4*d*1 and a button block 4*d*2.

In some embodiments, a shape of the button block 4*d*2 may be a rectangle with rounded corners, and the button block 4*d*2 may extend along a length direction of the outer side wall 1612. The button block 4*d*2 may include two symmetry axes (e.g., a long axis and a short axis), and the button block 4*d*2 may be arranged symmetrically in two symmetry directions, and the symmetry directions are perpendicular to each other.

Figure 21:
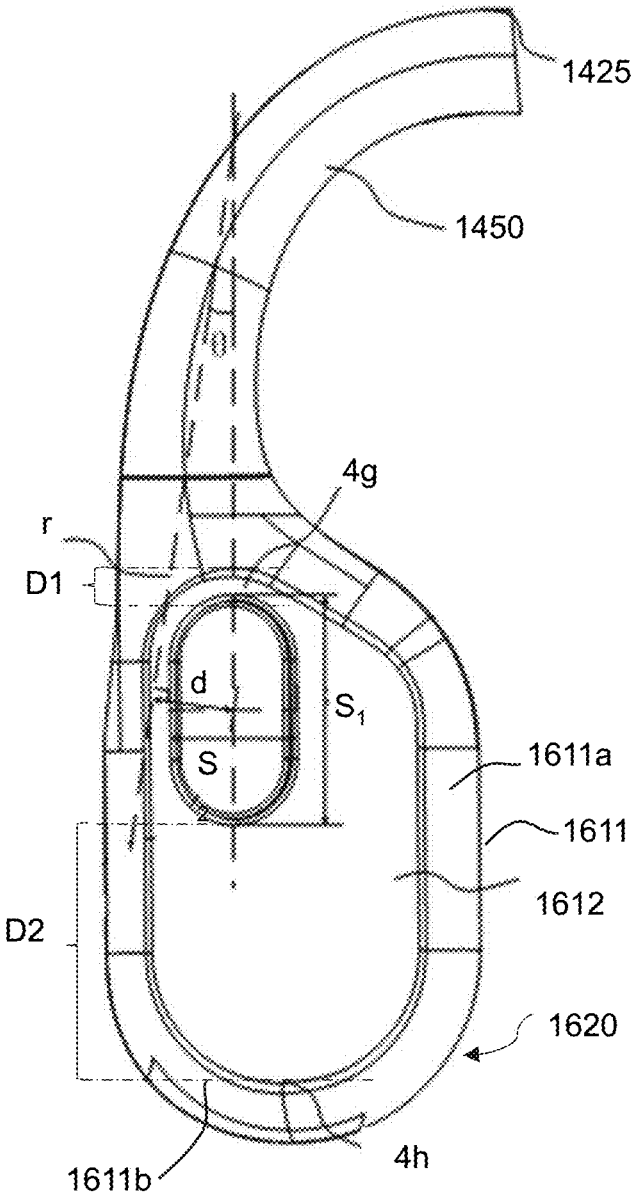
FIG. 21 is a schematic diagram illustrating a third distance D1 and a fourth distance D2 according to some embodiments the present disclosure.

FIG. 21 is a schematic diagram illustrating a distance D1 and a distance D2 according to some embodiments the present disclosure. As shown in FIG. 21, a vertical distance (along the long axis direction of the button 4*g*) between a top of the button 4*g* and a top end position of an outer side wall 1612 is the third distance D1. A vertical distance between a bottom of the button 4*g* and a bottom end position of the outer side wall 1612 is the fourth distance D2. A ratio of the third distance D1 to the fourth distance D2 may not be greater than a fourth ratio threshold. For example, the ratio of the third distance D1 to the fourth distance D2 may not be greater than 1.

Specifically, when the ratio of the third distance D1 to the fourth distance D2 is equal to 1, the button 4*g* may be located in a middle position of the outer side wall 1612. When the ratio of the third distance D1 and the fourth distance D2 is less than 1, the button 4*g* may be located between the middle position and the top end position of the outer side wall 1612.

In some embodiments, the ratio of the third distance D1 to the fourth distance D2 may be not greater than 0.95, and the button 4*g* may be located closer to the top end position of the outer wall 1612 than the bottom end position, thereby improving a volume of a speaker assembly 1440. In some embodiments, the ratio of the third distance D1 to the fourth distance D2 may be 0.9, 0.8, 0.7, 0.6, 0.5, etc., which may be determined according to different needs and is not limited herein.

In some embodiments, a connection portion connecting the ear hook 50 and the speaker module may have a central axis. In some embodiments, an extension line r of the central axis may have a projection on a plane where the outer surface of the button 4*g* locates. An angle θ formed between the projection and the long axis direction of the button 4*g* may be less than an angle threshold. In some embodiments, the angle θ formed between the projection and the long axis direction of the button 4*g* may be less than 10°, for example, 9°, 7°, 5°, 3°, 1°, etc., which is not limited herein.

When the angle θ formed between the projection of the extension line r on the plane where the outer surface of the button 4*g* locates and the long axis direction is less than 10°, a deviation of the long axis direction of the button 4*g* from the extension line r may be relatively small, and the long axis direction of the button 4*g* may be regarded as consistent or substantially consistent with the direction of the extension line r of the central axis.

In some embodiments, the long axis direction of the outer surface of the button 4*g* and the short axis direction of the outer surface of the button 4*g* may have an intersection. A distance d between the projection and the intersection may be relatively small. The distance d may be less than a width $S_2$ of the outer surface along the short axis direction of the button 4*g*, making the button 4*g* close to the extension line r of the central axis of the ear hook 1450. In some embodiments, the projection of the extension line r of the central axis of the earhook 1450 on the plane where the outer surface of the button 4*g* locates may coincide with the long axis direction of the button 4*g*, thereby further improving the sound quality of the speaker assembly 1440.

In some embodiments, a long axis of the button 4*g* may be in a direction from the top of the button 4*g* to the bottom of the button 4*g*, or a direction in which the ear hook 1450 may be connected to the housing 1620. The short axis of the button 4*g* may be perpendicular to the long axis of the button 4*g* and pass through a midpoint of a line connecting the top of the button 4*g* and the bottom of the button 4*g*. A size of the button 4*g* along the long axis direction may be $S_1$, and a size of the button 4*g* along a circumferential direction may be $S_2$.

In some embodiments, the first peripheral side wall 1611*a* may have a bottom end position, a middle position, and a top end position.

The bottom end position of the first peripheral side wall 1611*a* may include a connection point connecting the first peripheral side wall 1611*a* and the second peripheral side wall 1611*b* which is away from the ear hook 1450. The top end position may include a connection point connecting the first peripheral side wall 1611*a* and the second peripheral side wall 1611*b* which is close to the ear hook 1450. The middle position may include a midpoint of a line connecting the bottom end position and the top end position of the first peripheral side wall 1611*a*.

In some embodiments, the button 4*g* may be disposed on the middle position of the first peripheral side wall 1611*a* (not shown in the figure), or between the middle position and the top end position of the first peripheral side wall 1611*b* (not shown in the figure). The button 4*g* may be centrally disposed on the first peripheral side wall 1611*a* along a width direction of the first peripheral side wall 1611*a* (the width direction of the first peripheral side wall is perpendicular to the plane where the outer surface of the button 4*g* locates).

Figure 22:
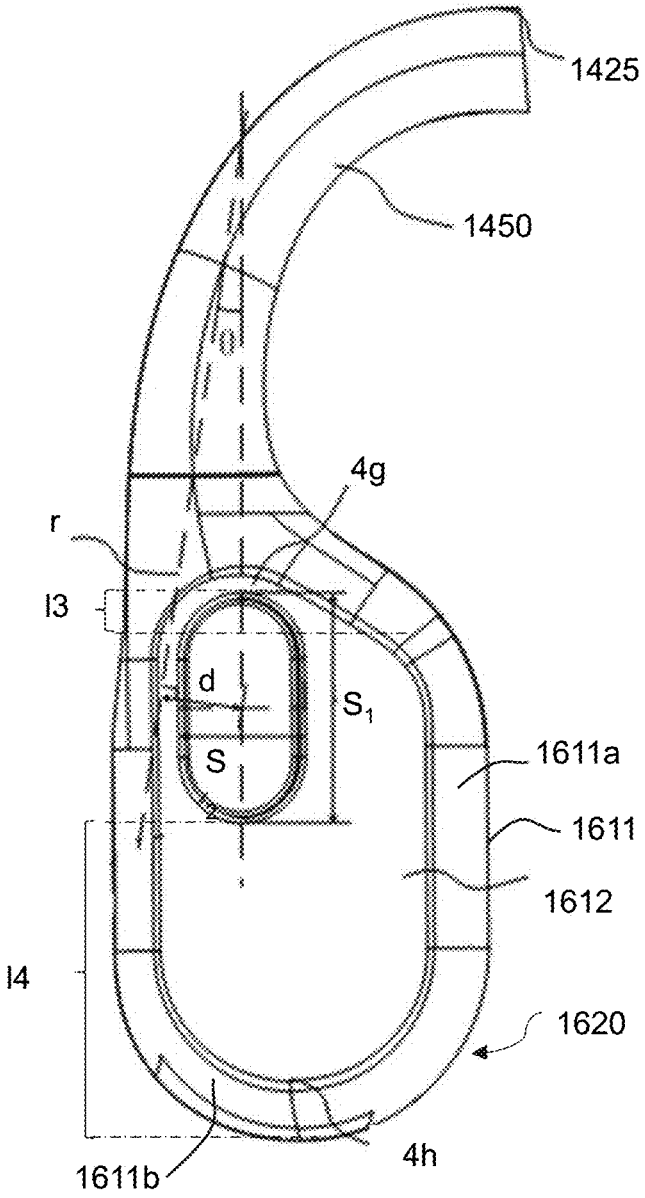
FIG. 22 is a schematic diagram illustrating a fifth distances l3 and a sixth distance l4 according to some embodiments of the present disclosure.

FIG. 22 is a schematic diagram illustrating a fifth distance l3 and a sixth distance l4 according to some embodiments of the present disclosure. As shown in FIG. 22, the fifth distance l3 refers to a vertical distance (along the long axis direction of the button 4*g*) between a top of a button 4*g* and a top end position of a first peripheral side wall 1611*a*. The sixth distance l4 refers to a vertical distance between a bottom of the button 4*g* and a bottom end position of the first peripheral side wall 1611. A ratio of the fifth distance l3 to the sixth distance l4 may be not greater than a fifth ratio threshold. For example, the ratio of the fifth distance l3 to the sixth distance l4 may be not greater than 1.

Further, the ratio of the fifth distance l3 to the sixth distance l4 may be not greater than 0.95, so that the button 4*g* may be relatively close to the top end position of the first peripheral side wall 1611*a*, that is, the button 4*g* may be relatively close to the vibration fulcrum, thereby improving the volume generated by a speaker assembly (e.g., the speaker assembly 1440). The ratio of the fifth distance l3 to the sixth distance l4 may also be 0.9, 0.8, 0.7, 0.6, 0.5, etc., which may be determined according to the actual need and not limited herein.

It should be noted that the above descriptions are only some specific examples and should not be regarded as the only feasible implementations. Obviously, for those skilled in the art, after understanding the basic principle of the bone conduction speaker, it is possible to make various modifications in forms and details to the specific methods and steps of implementing the bone conduction speaker without departing from this principle of the present disclosure. For example, the button 4*g* may be disposed in one of the speaker assemblies on the left side and right side of the bone conduction speaker. As another example, the button 4*g* may be disposed in both speaker assemblies on the left side and right side of the bone conduction speaker. However, those variations, changes, and modifications do not depart from the scope of the present disclosure.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. A bone conduction speaker comprising:

a vibration device having a vibration conductive plate and a vibration board, wherein the vibration conductive plate is physically connected with the vibration board, vibrations generated by the vibration conductive plate and the vibration board have at least two resonance peaks, frequencies of the at least two resonance peaks being in a range of 20 Hz-20000 Hz, and sounds are generated by the vibrations transferred through a human bone;

an ear hook, wherein the ear hook is configured to contact with the head of a user, one or more contact points of the ear hook and the head of the user include a vibration fulcrum of the vibration device when the vibration device vibrates; and at least one button, wherein the at least one button is configured for user operation, and a distance between a center of a button of the at least one button and the vibration fulcrum is not greater than a distance between a center of the vibration device and the vibration fulcrum.

2. The bone conduction speaker according to claim 1, wherein the center of the button of the at least one button includes a center of mass or a centroid of the button.

3. The bone conduction speaker according to claim 1, wherein the vibrations of the vibration device is indicated by a first ratio of a first distance to a second distance, and a second ratio of a mass of the button to a mass of the vibration device, the first distance representing a distance between the center of the button and the vibration fulcrum, the second distance representing a distance between a center of the vibration device and the vibration fulcrum.

4. The bone conduction speaker according to claim 1, wherein the first ratio is not greater than a first ratio threshold.

5. The bone conduction speaker according to claim 4, wherein the second ratio is not greater than a second ratio threshold.

6. The bone conduction speaker according to claim 1, wherein the first ratio is not greater than a third ratio threshold.

7. The bone conduction speaker according to claim 1, wherein the bone conduction speaker further includes a housing for accommodating the vibration device, the housing includes an outer side wall and a peripheral side wall.

8. The bone conduction speaker according to claim 7, wherein a ratio of the third distance to a fourth distance is not be greater than a fourth ratio threshold, the third distance representing a vertical distance between a top of the button and a top end position of the outer side wall, the fourth distance representing a vertical distance between a bottom of the button and a bottom end position of the outer side wall.

9. The bone conduction speaker according to claim 7, wherein the peripheral side wall includes a first peripheral side wall arranged along a length direction of the outer side wall, a ratio of the fifth distance to a sixth distance is not be greater than a fifth ratio threshold, the fifth distance representing a vertical distance between a top of the button and a top end position of the first peripheral side wall, the sixth distance representing a vertical distance between a bottom of the button and a bottom end position of the first peripheral side wall.

10. The bone conduction speaker according to claim 7, wherein the bone conduction speaker further includes a connection portion connecting the ear hook and the vibration device, the connection portion has a central axis, an extension line of the central axis has a projection on a plane where the outer surface of the button locates, and an angle formed between the projection and the long axis direction of the button is less than an angle threshold.

11. The bone conduction speaker according to claim 1, wherein the vibration conductive plate includes a first torus and at least two first rods, the at least two first rods converging to a center of the first torus.

12. The bone conduction speaker according to claim 11, wherein the vibration board includes a second torus and at least two second rods, the at least two second rods converging to a center of the second torus.

13. The bone conduction speaker according to claim 12, wherein the first torus is fixed on a magnetic component.

14. The bone conduction speaker according to claim 13, further comprising a voice coil, wherein the voice coil is driven by the magnetic component and fixed on the second torus.

15. The bone conduction speaker according to claim 14, wherein the at least two first rods are staggered with the at least two second rods.

16. The bone conduction speaker according to claim 15, wherein a staggered angle between one of the at least two first rods and one of the at least two second rods is 60 degrees.

17. The bone conduction speaker according to claim 14, wherein the magnetic component comprises:

a bottom plate;

an annular magnet attaching to the bottom plate;

an inner magnet concentrically disposed inside the annular magnet;

an inner magnetic conductive plate attaching to the inner magnet;

an annular magnetic conductive plate attaching to the annular magnet; and a grommet attaching to the annular magnetic conductive plate.

18. The bone conduction speaker according to claim 1, wherein the vibration conductive plate is made of stainless steels and has a thickness in a range of 0.1 to 0.2 mm.

19. The bone conduction speaker according to claim 1, wherein a lower resonance peak of the at least two resonance peaks is equal to or lower than 900 Hz.

20. The bone conduction speaker according to claim 19, wherein a higher resonance peak of the at least two resonance peaks is equal to or lower than 9500 Hz.

* * * * *